US008479477B2

(12) United States Patent
Mitten et al.

(10) Patent No.: US 8,479,477 B2
(45) Date of Patent: Jul. 9, 2013

(54) FOLDED PACK FOR HOLDING THIN ELONGATE PRODUCTS

(75) Inventors: Robert T. Mitten, Glen Allen, VA (US); Christopher J. Hession, Mechanicsville, VA (US); Edward C. Fuller, Ashland, VA (US)

(73) Assignee: Altria Client Services Inc., Richmond, VA (US)

( * ) Notice: Subject to any disclaimer, the term of this patent is extended or adjusted under 35 U.S.C. 154(b) by 0 days.

(21) Appl. No.: 13/562,645

(22) Filed: Jul. 31, 2012

(65) Prior Publication Data

US 2012/0291403 A1 Nov. 22, 2012

Related U.S. Application Data

(63) Continuation of application No. 12/785,149, filed on May 21, 2010, now Pat. No. 8,235,205.

(51) Int. Cl.
*B65B 3/02* (2006.01)

(52) U.S. Cl.
USPC ..... 53/456; 53/533

(58) Field of Classification Search
USPC ..... 53/456, 533; 206/380, 443, 104, 206/113, 100, 369, 63.3, 800, 271, 38, 96, 206/242, 268, 273, 121
See application file for complete search history.

(56) References Cited

U.S. PATENT DOCUMENTS

| | | | | |
|---|---|---|---|---|
| 656,349 | A | | 8/1900 | Hilson |
| 969,141 | A | | 8/1910 | Hankins |
| 1,615,200 | A | | 1/1927 | Shrum |
| 1,824,491 | A | * | 9/1931 | Molins ..... 206/273 |
| 1,837,602 | A | | 12/1931 | Walter |
| 1,854,849 | A | * | 4/1932 | Lerch ..... 206/100 |
| 1,883,852 | A | * | 10/1932 | Medoff ..... 206/449 |
| 2,117,281 | A | | 5/1938 | Bravi |
| 2,326,390 | A | | 8/1943 | Platt |
| 3,035,756 | A | | 5/1962 | Mullinix |
| 3,524,580 | A | | 8/1970 | Heyworth |
| 4,166,534 | A | | 9/1979 | Bowden |
| 5,123,589 | A | | 6/1992 | Cote |
| 5,505,376 | A | | 4/1996 | Kent et al. |
| 6,044,848 | A | | 4/2000 | Huang |
| D519,386 | S | | 4/2006 | Aldridge et al. |

(Continued)

FOREIGN PATENT DOCUMENTS

GB 2256425 A 12/1992

OTHER PUBLICATIONS

International Search Report and Written Opinion mailed May 10, 2010 for PCT/EP2009/009324.

(Continued)

*Primary Examiner* — Hemant M Desai
(74) *Attorney, Agent, or Firm* — Buchanan Ingersoll & Rooney PC

(57) ABSTRACT

A folded, substantially wedge shaped pack useful for holding thin, elongate products such as tobacco sticks includes a back panel, inner front panel, top panel and front closure panel, the front closure panel including a tab at a free end thereof engageable with a closure slot in the inner front panel. The closure tab slides into the closure slot by sliding along a bearing surface and the top panel establishes a raised fulcrum effect which tends to maintain the closure tab in the closure slot when the pack is in a closed condition.

20 Claims, 5 Drawing Sheets

U.S. PATENT DOCUMENTS

| | | | | |
|---|---|---|---|---|
| 7,159,717 | B2 | 1/2007 | Aldridge et al. | |
| 7,325,686 | B2 | 2/2008 | Aldridge | |
| 7,353,940 | B2 | 4/2008 | Sendo | |
| 7,533,773 | B2 | 5/2009 | Aldridge et al. | |
| 7,624,913 | B2 | 12/2009 | Lutzig | |
| 8,067,046 | B2 | 11/2011 | Schleef et al. | |
| 8,118,165 | B2 * | 2/2012 | Duvekot et al. | 206/474 |
| 8,235,205 | B2 | 8/2012 | Mitten et al. | |
| 2004/0055257 | A1 * | 3/2004 | Parrotta et al. | 53/456 |
| 2008/0202536 | A1 | 8/2008 | Torrence et al. | |

OTHER PUBLICATIONS

International Search Report and Written Opinion mailed Sep. 6, 2011 for PCT/US2011/000907.

* cited by examiner

FOLDED PACK FOR HOLDING THIN ELONGATE PRODUCTS

CROSS-REFERENCE TO RELATED APPLICATIONS

This application is a continuation application of U.S. application Ser. No. 12/785,149 entitled Folded Pack for Holding Thin Elongate Products, filed on May 21, 2010 now U.S. Pat. No. 8,235,205,now U.S. Pat. No. 8,235,205, the entire content of which is incorporated herein by reference.

BACKGROUND OF THE INVENTION (1) Field of the Invention

This invention relates to a folded pack for holding thin, elongate products such as tobacco sticks.

(2) Description of the Related Art

Not Applicable

BRIEF SUMMARY OF THE INVENTION

A folded and substantially flattened pack as set forth in the claims, the subject matter and text of which is hereby incorporated by reference.

BRIEF DESCRIPTION OF FIGURES

FIGS. 7-9 show the pack during loading of thin elongated product therein wherein FIG. 7 shows the product on a loading plunger prior to insertion in the pack, FIG. 8 shows partial loading of the pack and FIG. 9 shows the pack after loading and with the plunger removed.

DETAILED DESCRIPTION

Figure 1:
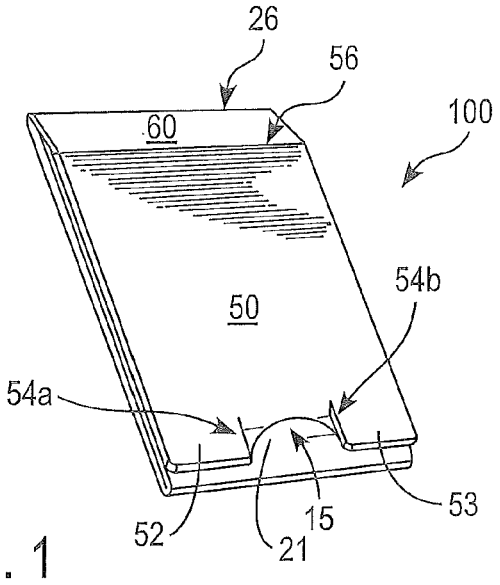
FIG. 1 shows a perspective view of the pack in a fully folded closed state.
Figure 4:
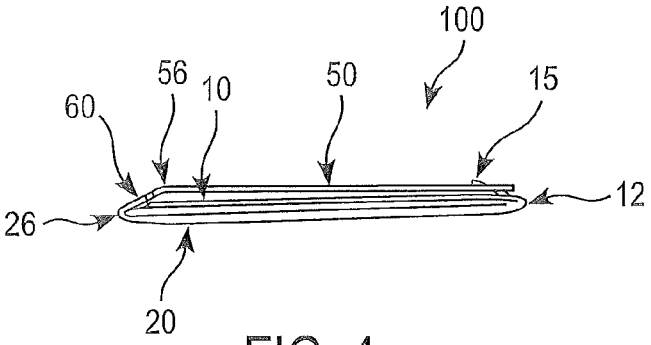
FIG. 4 shows a side view of the pack in a fully folded closed state.

A folded and substantially flattened pack useful for holding thin, elongate products such as tobacco sticks 98 is described herein. The tobacco sticks 98 can comprise wood (or polymer based) sticks with orally enjoyed tobacco material coated on one end of the sticks.

Referring to FIGS. 1-5, the pack 100 comprises an inner front panel 10; a back panel 20 connected to the inner front panel 10 along a transverse fold line 12; a top panel 60 connected to the back panel 20 along a transverse fold line 26; a front closure panel 50 connected to the top panel 60 along a transverse fold line 56. The pack 100 can also comprise a left side panel 30 connected to a side of the back panel 20 along a longitudinal fold line 23; a right side panel 40 connected to an opposite side of the back panel 20 along another longitudinal fold line 24.

Figure 3:
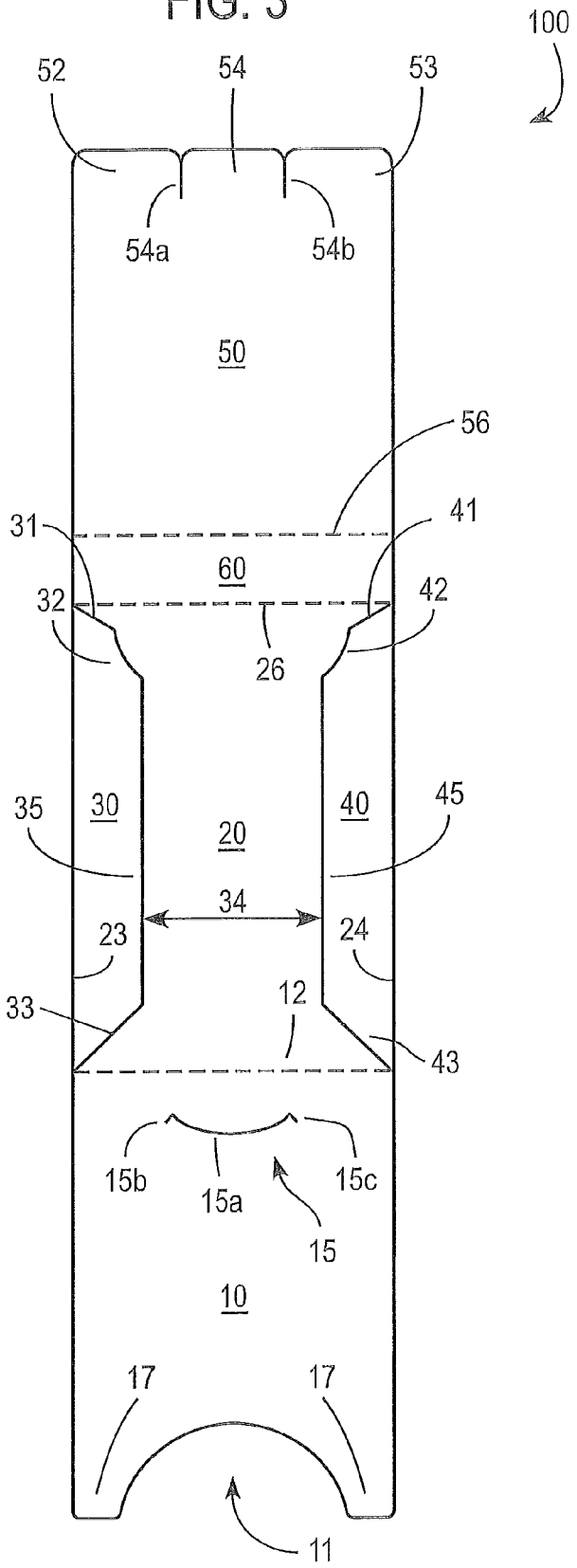
FIG. 3 shows a top view of the pack blank in a partially folded state.

Referring to FIG. 3, the left and right side panels 30 and 40 can be folded over the back panel 20 along the longitudinal fold lines 23 and 24 with a gap 34 between opposed side edges 35 and 45 of the left and right side panels 30 and 40. The inner front panel 10 can be folded over the back panel 20 along the transverse fold line 12 and adhered to the folded left and right side panels 30 and 40 by an adhesive so as to form a pocket sized pack to receive thin elongate products therein. The adhesive preferably is located only in an overlap of the left side panel 30 and the inner front panel 10 and in an overlap of the right side panel 40 and the inner front panel 10. The top panel 60 and front closure panel 50 can be folded over the back panel 20 along the transverse fold line 26 and the transverse fold line 56, respectively. In the fully folded closed state, the front closure panel 50 overlies the inner front panel 10.

The left side panel 30 can have a first angled edge portion 31 and an arcuate edge portion 32. The right side panel 40 can have a first angled edge portion 41 and an arcuate edge portion 42. The first (upper) angled edge portions 31 and 41 provide bond (glue) surfaces which adhere to upper should portions 17 of the inner front panel.

The left and right side panels 30 and 40 can include second angled edges 33 and 43 extending from the side edges 35 and 45 of the left and right side panels 30 and 40 to the transverse fold line 12 between the inner front panel 10 and the back panel 20. The left and right side panels 30 and 40 preferably each have a width of 20% to 30% of the width of the back panel 20.

Figure 5:
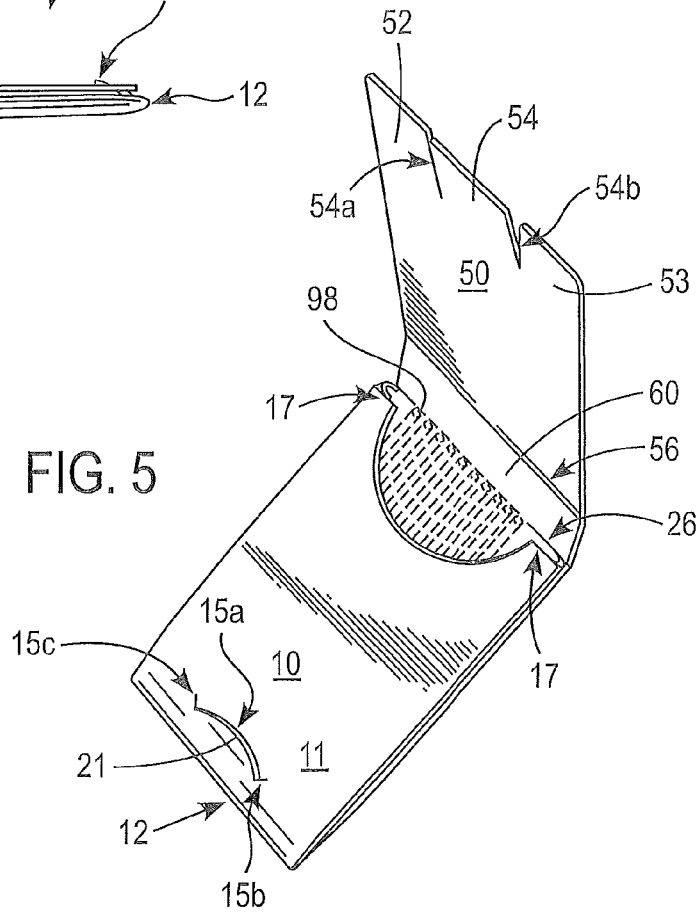
FIG. 5 shows a perspective view of the pack in an open state.

The inner front panel 10 includes a closure slot 15 adjacent (e.g. preferably within 25% of the longitudinal length of the inner front panel 10) to the transverse fold line 12 and overlying the gap 34 (as shown in FIG. 5). The closure slot 15 can include a transversely extending curved portion 15*a* and straight portions 15*b* and 15*c* at each end thereof. The curved portion 15*a* has a concave side facing the transverse fold line 12. The straight portions 15*b* and 15*c* extend diagonally away from the curved portion 15*a* and the transverse fold line 12. The inner front panel 10 is rectangular and can have a centrally located arcuate cutout 11 at a free end thereof. The arcuate edge portions 32 and 42 of the left and right side panels 30 and 40 preferably are aligned with portions of the arcuate cutout 11 when the side panels 30, 40 are adhered to the inner front panel 10. The back panel 20 preferably has a length greater than the length of the inner front panel 10. In the fully folded closed state and the fully folded open state, the inner front panel 10 superposes a substantial length of the back panel 20, and an edge portion at the free end of the inner front panel 10 is spaced from the top panel 60 a sufficient distance to permit rotation of the top panel 60 into an acute angular relation with respect to the back panel 20. The closure slot 15 can have any desired dimension such as up to one-half and preferably about one-third of the width of the back panel 20. The inner front panel 10 preferably does not include any openings inwardly of outer edges of the inner front panel 10.

The front closure panel 50 includes a closure tab 54 at a free edge portion opposite the transverse fold line 56. The front closure panel 50 is rectangular and the closure tab 54 is defined by two longitudinally extending slits 54*a* and 54*b*, the slits 54*a* and 54*b* extending preferably 20% or less of the length of the front closure panel 50. The slits 54*a* and 54*b* preferably end in V-shaped cutouts. The closure tab 54 preferably is rectangular and/or has a length approximately the length of the top panel 60. In the fully folded closed state, the closure tab 54 can engage the closure slot 15 (e.g. at least a portion of the closure tab 54 is inserted underneath the inner front panel 10 through the closure slot 15); the edge portion of the front closure panel 50 opposite the transverse fold line 56 is retained adjacent the transverse fold line 12; the top panel 60 forms an acute angle with the back panel 20 when the closure tab 54 is fully inserted in the closure slot 15; and the top panel 60 establishes a raised fulcrum effect which tends to maintain the closure tab 54 in engagement with the closure slot 15 when the pack is in a closed condition.

The front closure panel 50 preferably has a length less than a length of the back panel 20. A portion 52 defined by a left edge of the front closure panel 50 and the left slit 54*a* of the closure tab 54 and a portion 53 defined by a right edge of the front closure panel 50 and the right slit 54*b* of the closure tab 54 are rectangular in shape and substantially the same size as the closure tab 54. The free ends of the left and right portions 52 and 53 preferably position proximately to the fold line 12 when the closure tab 54 is fully inserted in the closure slot 15.

The inner front panel 10 can include a finished bearing surface at a location over the gap 34, the bearing surface providing smooth sliding of the closure tab 54 into the closure slot 15. The front closure panel 50 can be urged against the bearing surface of the inner front panel 10 to facilitate engagement of the tab 54 with the slot 15. The closure tab slides into the closure slot by sliding along the bearing surface and is held in the closure slot by a force exerted by a raised fulcrum effect of the top panel 60. Bowing of the inner front panel 10 (as described with reference to FIGS. 7-9) raises the raised lip portion 21 adjacent the closure slot 15. The raised lip 21 facilitates entry of the tab 54 into the closure slot 54. Also, the bearing surface preferably is manually depressible to expand the closure slot 15 to allow easy insertion and removal of the closure tab 54 into and out of the closure slot 15. The top panel 60 and the front closure panel 50 cooperate for single handed or dual handed opening and closing of the pack 100 similar to operation of a hinged lid cigarette package. For example, a human user of the pack 100 can slide the closure tab 54 into and out of the closure slot 15 by nudging a thumb on the front closure panel 50.

In the embodiment shown in FIG. 5, the pack 100 can hold a plurality (e.g. ten) of tobacco sticks aligned longitudinally in a pocket formed between the back panel 20 and the inner front panel 10. Preferably, at least one of the tobacco sticks is in a space between the side panels 30 and 40 and the back panel 20 with portions of the tobacco sticks visible in the cutout 11. The tobacco sticks can have a length of about 2.5 inches and a tobacco coating on one end of each stick can have a diameter of about 0.1 inch. Preferably, the pack is wedge shaped in the closed state with a transverse width of about 1.8 inches, a longitudinal length of about 2.8 inches and a thickness from front panel to back panel of about 0.2 inch at the bottom to about 0.4 inch at the top.

A method of packaging thin, elongate products such as tobacco sticks in a shallow, rectangular, board pack such as the pack 100, comprises (a) establishing a planar blank of board material such as paper or plastic, the planar blank comprising the inner front panel 10, the back panel 20 connected to the inner front panel 10 along the transverse fold line 12, the left side panel 30 connected to a side of the back panel 20 along the longitudinal fold line 23, the right side panel 40 connected to an opposite side of the back panel 20 along the longitudinal fold line 24, the top panel 60 connected to the back panel 20 along the transverse fold line 26, the front closure panel 50 connected to the top panel 60 along the transverse fold line 56, such that the top panel 60 is interposed between the back panel 20 and the front closure panel 10, the front closure panel 10 including a free, transverse, edge portion and the closure tab 54 established with longitudinal slits 54*a* and 54*b* in the free edge portion; the inner front panel 10 including the closure slot 15 adjacent the transverse fold line 12; (b) folding the left and right side panels 30 and 40 over the back panel 20 and establishing the gap 34 between opposed side edges 35 and 45 of the left and right side panels 30 and 40; (c) folding the inner front panel 10 over the back panel 20 and adhering portions of the front closure panel 50 to portions of the left and right side panels 30 and 40 so as to form a planar pack structure with the closure slot 15 being disposed over the gap 34; (d) inserting the thin elongate products into the planar pack structure and bowing the inner front panel 10 from placement of product thereunder such that a raised lip portion 15*a* of the inner front panel 10 is established adjacent the closure slot 15; (e) closing the pack by folding the front closure panel 50 into a superposed relation with the inner front panel 10 and engaging the closure tab 54 with the closure slot 15 by moving the free, transverse edge portion of the front closure panel 50 along the inner front panel 10 toward the closure slot 15, wherein the raised lip portion 21 of the closure slot 15 guides the closure tab 54 into the closure slot 15 and the top panel 60 is rotated into an acute angle with respect to the back panel 20.

Figure 2:
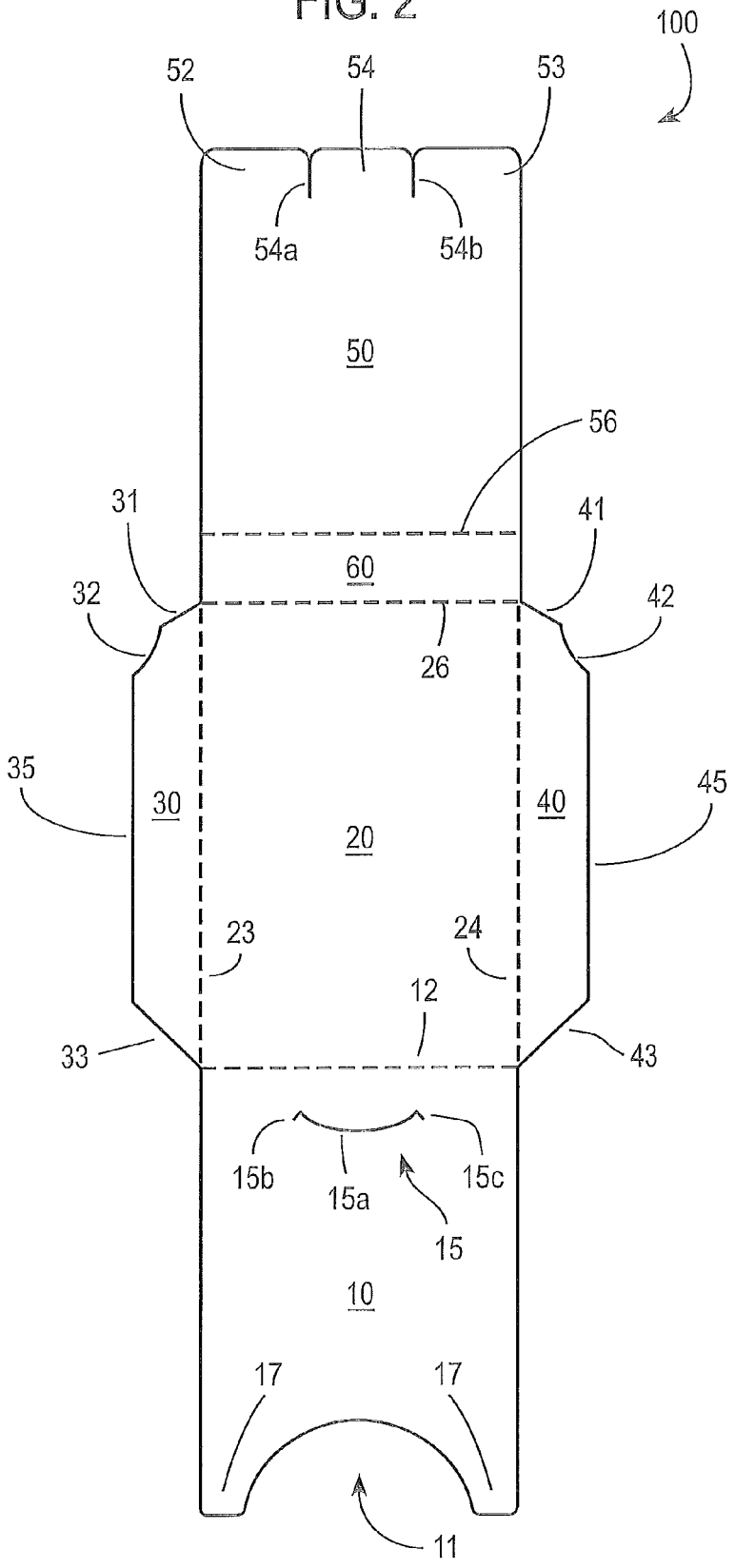
FIG. 2 shows a planar view of the pack blank in an unfolded state.
Figure 6:
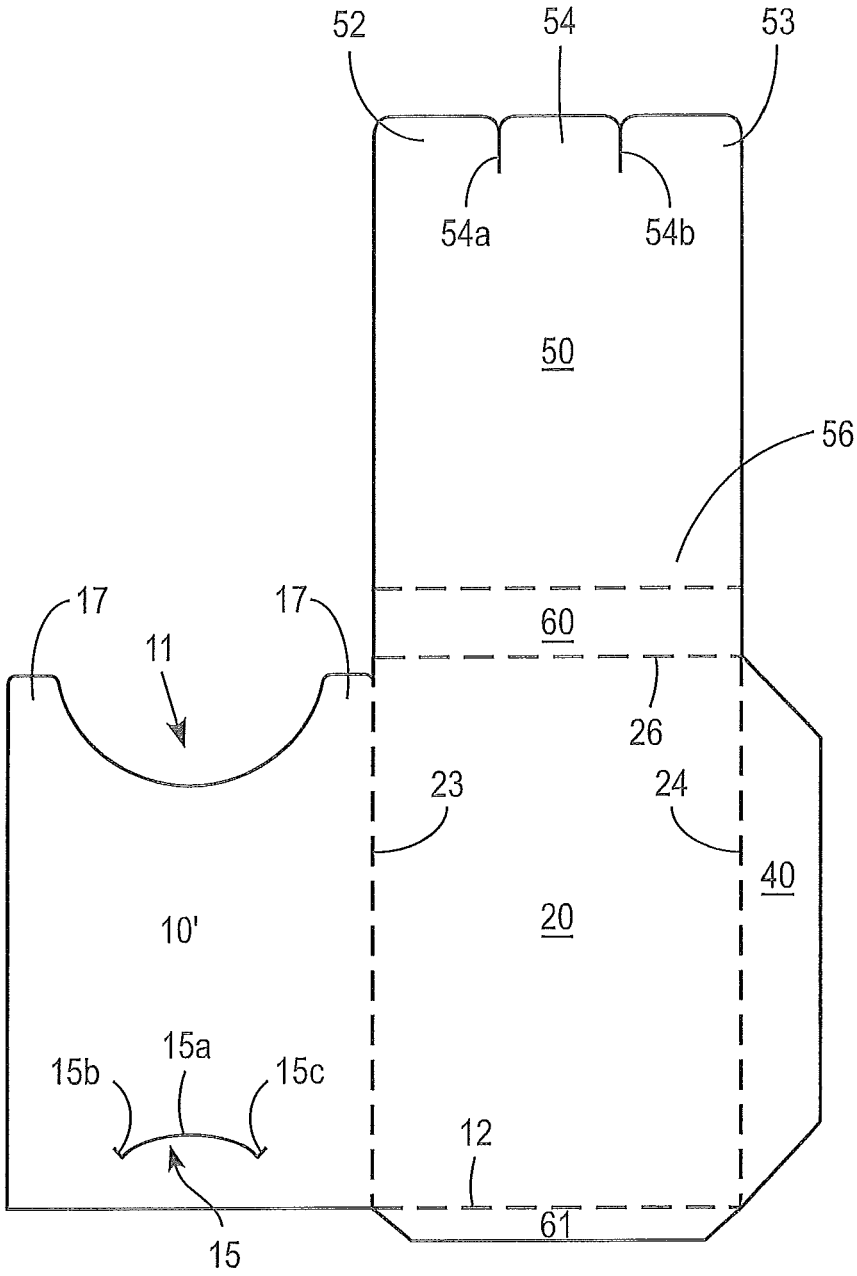
FIG. 6 shows a planar view of a pack blank in an unfolded state according to a further embodiment.

FIG. 6 shows a pack blank according to a further embodiment wherein side panel 30 of the blank shown in FIG. 2 is replaced with inner front panel 10' and inner front panel 10 is replaced with a bottom panel 61. In this embodiment, side panel 40 and bottom panel 61 are folded over back panel 20 and inner front panel 10' is then folded over back panel 20 and adhered to side panel 40 and bottom panel 61.

Figure 7:
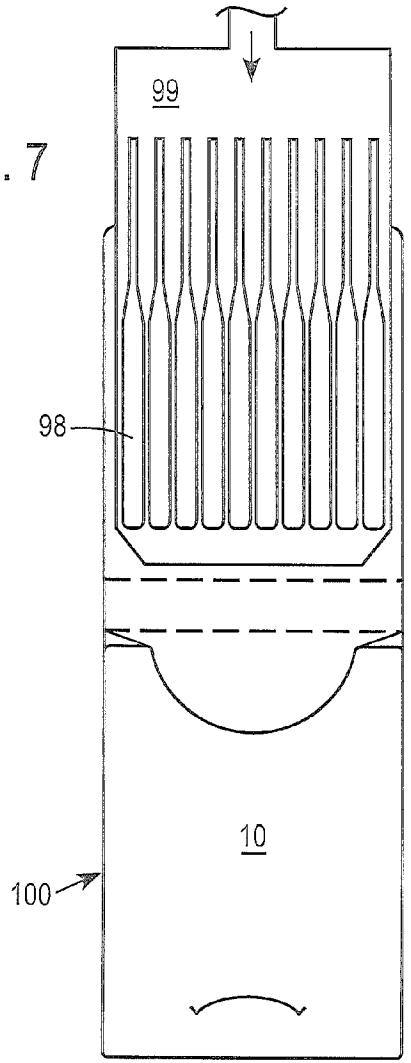
Figure 8:
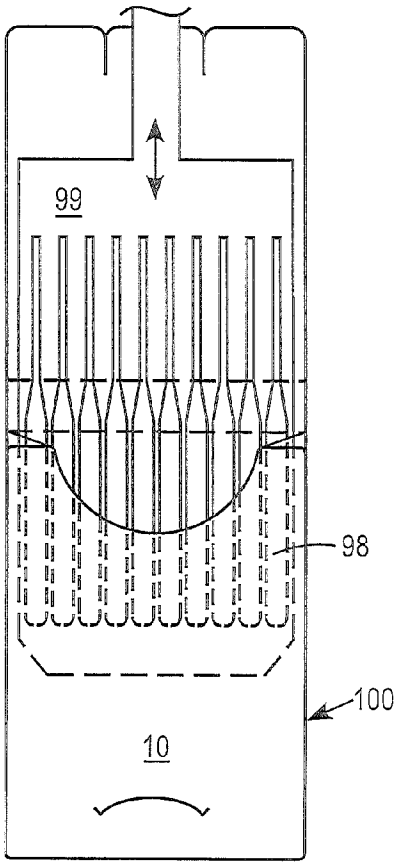
Figure 9:
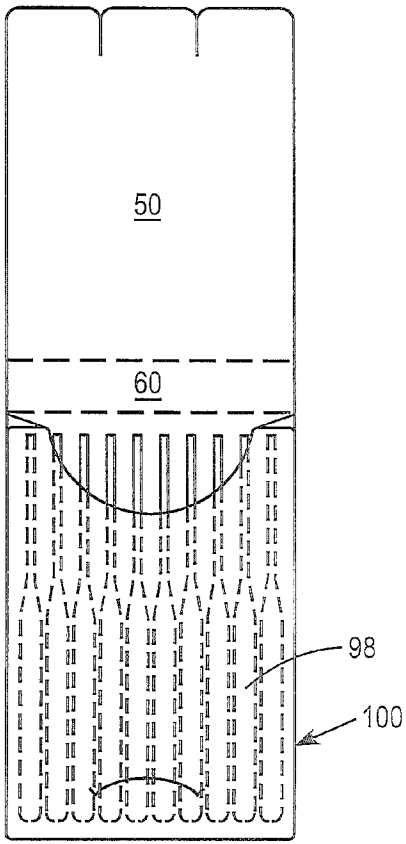

FIGS. 7-9 show an exemplary mechanized arrangement for loading of thin elongate product in the form of tobacco sticks 98 into pack 100. In high speed manufacture, pack blanks would be fed to a station at which adhesive is applied to panels to be bonded, the side and inner front panels would be folded and bonded at the adhesive sites to form an open pack with a pocket between the back panel and the inner front panel. The pack with the front closure panel 50 in an unfolded state would then be fed to a loading station at which product 98 carried by a loading plunger 99 is moved in the direction of the arrow shown in FIG. 7 until a leading knife edge of the plunger enters the pocket in the pack 100. FIG. 8 shows the product 98 carried by plunger 99 partially inserted in the pocket and FIG. 9 shows the product 98 fully inserted into the pocket with the plunger removed. Then, the front closure panel is folded over the inner front panel and slid towards the closure slot to engage tab 54 in the slot 15.

The top panel and the closure mechanism provide a shallow wedge shape that facilitates placement of the pack in a shirt pocket or confine it within a lady's purse. The closure mechanism secures the lower edge of the front closure panel to closely overlie the inner front panel, which minimizes snags, helps maintain closure if a snag should occur and avoids accidental opening of the pack.

The closure mechanism resists side to side displacement of the front closure panel 50. Thus, the closure mechanism maintains the front closure panel edges aligned with the edges of the back panel and inner front panel.

The top panel 60 is narrow and is sized to allow the release of the tab 54 of the front closure panel 50 from the closure slot 15 upon its rotation from an acute angle with respect to the back panel 20 (when the pack is closed) to an obtuse angle with respect to the back panel 20 when the outer front panel 50 is released from the catching mechanism. This feature avoids bowing and bending of the outer front panel 50 which instead remains substantially planar during opening and reclosure, so the pack can sustain 20 or more openings without much degradation of the outer front panel 50.

The narrow top panel also maximizes the length of the outer front panel 50 so that the latter extends along a great portion of the overall pack length. This relationship maximizes the amount of available area on the outer front panel for warning labels, commercial indicia and regulatory notices.

Preferably, for a closed pack having an overall length of about 2.8 inches, the top panel preferably has a length of about 0.4 inch. Thus, the top panel has a longitudinal length of about 1/7 or about 14 to 15% of the pack length.

Advantageously, the breaking of the leading edge 53, 52 of the outer front closure panel 50 is minimized at the closure slot 15, due in substantial part to the sliding, frictional fit established by the cuts 54*a*, 54*b* and 15*a* in the front panels 50 and 10, respectively; and the raised lip portion 15*a* and the bowed condition of the lower portion of inner front panel 10 when loaded with product 98.

The slot portions 15*b*, 15*c* provide stress relief in the area of slot 15 and reduces potential of slot 15 tearing toward score line 12.

While the pack and the method of packaging have been described in detail with reference to specific embodiments thereof, it will be apparent to those skilled in the art that various changes and modifications can be made, and equivalents employed, without departing from the scope of the appended claims.

We claim:

1. A method of packaging thin, elongate products in a shallow, rectangular, board pack, said method comprising:

establishing a planar blank of board material, said blank comprising:

an inner front panel;

a back panel connected to the inner front panel along a first transverse fold line;

a left side panel connected to a side of the back panel along a first longitudinal fold line;

a right side panel connected to an opposite side of the back panel along a second longitudinal fold line;

a top panel connected to the back panel along a second transverse fold line;

a front closure panel connected to the top panel along a third transverse fold line, such that said top panel is interposed between said back panel and said front closure panel, said front closure panel including a free, transverse, edge portion and a closure tab established with longitudinal cuts in said free edge portion;

said inner front panel including a closure slot adjacent the first transverse fold line;

folding the left and right side panels over the back panel and establishing a gap between opposed side edges of the left and right side panels;

folding the inner front panel over the back panel and adhering portions of the inner front panel to portions of the left and right side panels so as to form a planar pack structure with said closure slot being disposed over said gap;

inserting said thin elongate products into said planar pack structure and bowing said inner front panel such that a raised lip portion of said inner front panel is established adjacent said closure slot;

closing said pack by folding said front closure panel into a superposed relation with said inner front panel and engaging said closure tab with said closure slot by moving said free, transverse edge portion of said front closure panel along said inner front panel toward said closure slot, whereby said raised lip portion of said closure slot guides said closure tab into said closure slot and said top panel is rotated into an acute angle with respect to said back panel, wherein adhesive is located only between the left and right side panels and the inner front panel.

2. The method of claim 1, wherein the left and right side panels each include a first angled edge having a length no greater than 10% longer than the length of the top panel.

3. The method of claim 1, wherein the back panel has a length greater than the length of the inner front panel.

4. The method of claim 1, wherein the closure slot includes a transversely extending curved portion and straight portions at each end thereof, the straight portions extending upwardly and outwardly away from the curved portion.

5. The method of claim 1, wherein the front closure panel is rectangular and the closure tab is defined by two longitudinally extending slits, the slits extending no more than 20% of the length of the front closure panel.

6. The method of claim 1, wherein the inner front panel is rectangular with a centrally located arcuate cutout at a free end thereof, the left and right side panels including arcuate edge portions which are aligned with portions of the arcuate cutout.

7. The method of claim 6, wherein the left and right side panels include angled edge portions extending from the arcuate edge portions to the transverse fold line between the back panel and the top panel.

8. The method of claim 1, wherein the closure tab has a length greater than the length of the top panel, the top panel establishes a raised fulcrum effect and exerts a closing force on the closure tab to maintain it in the closure slot.

9. The method of claim 1, wherein the front closure panel has a length less than a length of the back panel, the closure slot is located a distance less than 25% from the fold line between the inner front panel and the back panel, the closure tab is rectangular, left and right portions of the front closure panel on opposite sides of the tab are rectangular in shape and substantially the same size as the closure tab, and free ends of the left and right portions extend the full length of the pack.

10. The method of claim 1, wherein the inner front panel includes an exposed bearing surface at a location over the gap, the bearing surface providing smooth sliding of the closure tab into the closure slot during the step of closing said pack.

11. The method of claim 1, wherein the inner front panel includes an exposed bearing surface at a location over the gap.

12. The method of claim 1, wherein the inner front panel does not include any openings inwardly of outer edges of the inner front panel.

13. The method of claim 1, wherein the thin elongate products are a plurality of tobacco sticks aligned longitudinally in a pocket between the inner front panel and the back panel.

14. The method of claim 1, wherein the left and right side panels include angled bottom edges extending from the side edges to the transverse fold line between the inner front panel and the back panel.

15. The method of claim 1, wherein the left and right side panels have a width of 20 to 30% of the width of the back panel.

16. The method of claim 1, wherein the top panel and front closure panel cooperate for single handed opening and closing of the pack similar to operation of a hinged lid cigarette package.

17. The method of claim 13, wherein at least one of the tobacco sticks is in a space between the side panels and the back panel.

18. The method of claim 1, wherein the width of the closure slot is about one third the width of the back panel.

19. The method of claim 1, wherein the tab is defined by two longitudinal slits ending in V-shaped cutouts in the front closure panel.

20. A method of packaging thin, elongate products in a shallow, rectangular, board pack, said method comprising:

establishing a planar blank of board material, said blank comprising:

an inner front panel;

a back panel connected to the inner front panel along a first transverse fold line;

a left side panel connected to a side of the back panel along a first longitudinal fold line;

a right side panel connected to an opposite side of the back panel along a second longitudinal fold line;

a top panel connected to the back panel along a second transverse fold line;

a front closure panel connected to the top panel along a third transverse fold line, such that said top panel is interposed between said back panel and said front closure panel, said front closure panel including a free, transverse, edge portion and a closure tab established with longitudinal cuts in said free edge portion;

said inner front panel including a closure slot adjacent the first transverse fold line;

folding the left and right side panels over the back panel and establishing a gap between opposed side edges of the left and right side panels;

folding the inner front panel over the back panel and adhering portions of the inner front panel to portions of the left and right side panels so as to form a planar pack structure with said closure slot being disposed over said gap;

inserting said thin elongate products into said planar pack structure and bowing said inner front panel such that a raised lip portion of said inner front panel is established adjacent said closure slot; and closing said pack by folding said front closure panel into a superposed relation with said inner front panel and engaging said closure tab with said closure slot by moving said free, transverse edge portion of said front closure panel along said inner front panel toward said closure slot, whereby said raised lip portion of said closure slot guides said closure tab into said closure slot and said top panel is rotated into an acute angle with respect to said back panel, wherein the inner front panel is rectangular with a centrally located arcuate cutout at a free end thereof, the left and right side panels including arcuate edge portions which are aligned with portions of the arcuate cutout.

* * * * *